US008123188B2

(12) United States Patent
Banfield

(10) Patent No.: US 8,123,188 B2
(45) Date of Patent: Feb. 28, 2012

(54) APPARATUS FOR CONCEALING MULTIMEDIA DEVICES

(76) Inventor: Elliott Banfield, New York, NY (US)

( * ) Notice: Subject to any disclaimer, the term of this patent is extended or adjusted under 35 U.S.C. 154(b) by 351 days.

(21) Appl. No.: 12/386,749

(22) Filed: Apr. 22, 2009

(65) Prior Publication Data

US 2010/0270454 A1 Oct. 28, 2010

(51) Int. Cl.
*A47G 23/02* (2006.01)

(52) U.S. Cl. ..... 248/441.1; 248/919; 248/476; 248/923; 40/219

(58) Field of Classification Search ..... 248/475.1, 248/476, 489, 917, 918, 919, 921, 923; 40/219, 40/716, 714, 442
See application file for complete search history.

(56) References Cited

U.S. PATENT DOCUMENTS

| | | | | |
|---|---|---|---|---|
| 5,264,765 | A * | 11/1993 | Pecorino et al. | 318/265 |
| 6,826,859 | B1 * | 12/2004 | Lin | 40/514 |
| 6,901,987 | B1 * | 6/2005 | Graham | 160/121.1 |
| 7,106,578 | B2 * | 9/2006 | Chen | 361/679.21 |
| 7,251,125 | B2 * | 7/2007 | Heckerman | 361/679.27 |
| 7,287,737 | B2 | 10/2007 | Rossi | |
| 7,337,024 | B1 | 2/2008 | Graham | |
| 7,384,020 | B2 * | 6/2008 | Hsu | 248/146 |
| 2005/0168661 | A1 * | 8/2005 | Maxson | 348/825 |
| 2006/0076860 | A1 * | 4/2006 | Hoss | 312/312 |
| 2007/0188056 | A1 * | 8/2007 | Chang | 312/7.2 |
| 2010/0325929 | A1 * | 12/2010 | Favron | 40/638 |

* cited by examiner

*Primary Examiner* — Terrell McKinnon
*Assistant Examiner* — Monica Millner
(74) *Attorney, Agent, or Firm* — Law Offices of Alozie Etufugh, PLLC

(57) ABSTRACT

An apparatus for concealing a multimedia device. The apparatus may include a horizontal base with two vertical members, each vertical member being affixed to the horizontal base, with each vertical member having a metal plate affixed to the inner side of each vertical member. The apparatus may also include a pair of angular brackets, each bracket being rotationally coupled with each metal plate, a horizontal cross-piece, with each end of said cross-piece affixed to each angular bracket, a backing panel coupled with a picture frame and an art panel the backing panel being affixed to the horizontal cross-piece and a horizontal brace which is designed and adapted to support the weight of the picture frame, backing panel and the art panel.

15 Claims, 3 Drawing Sheets

APPARATUS FOR CONCEALING MULTIMEDIA DEVICES

BACKGROUND OF THE INVENTION

1. Field of the Invention

This invention is generally directed to a multimedia device enclosure, specifically, to an apparatus for concealing multimedia devices that are mounted on a stand.

2. Related Art

Multimedia devices such as flat-screen televisions are not aesthetically compatible many interior design layouts. In some instances, the multimedia device may not blend in with traditional furnishings. In fact, people may find them unattractive.

Previous attempts have been made to try to conceal multimedia devices; however, none have been designed or been able to conceal non-wall mounted multimedia devices, such as stand mounted devices. Most other systems or devices are designed to conceal devices installed within wall cavities.

In addition, the traditional method of displaying artwork such as framed prints, posters, paintings etc. requires wall mounting of such artwork. This traditional method may not be compatible with viewers' tastes in certain settings.

Further, previous systems or devices relied on motors or complicated systems to raise or lower a decorative cover in front of a multimedia device or to furl a covering over the multimedia device. As such, there is a need for a simple, attractive apparatus that conceals a multimedia device (when not in use) while presenting an aesthetically pleasing display of framed artwork such as print, painting, a poster, photograph, a low-relief sculpture, a tapestry, etc.

BRIEF DESCRIPTION OF THE INVENTION

The present invention meets the above-identified needs by providing an apparatus for enclosing multimedia devices that is also aesthetically pleasing. The present invention also provides an alternative to wall mounting of framed art by presenting the framed art at a level that allows it to be seen at a comfortable angle.

An advantage of the present invention is that it, according to an aspect of the present invention, provides an enclosure that is both functional and aesthetically pleasing.

Another advantage of the present invention is that it, according to an aspect of the present invention, provides a functional apparatus for concealing a multimedia device such as a flat screen television when the device is not in use.

An additional advantage of the present invention is that it, according to an aspect of the present invention, presents framed artwork (such as prints, paintings, posters, photographs, low-relief sculptures, tapestries, etc.) in an aesthetically satisfactory way.

A yet additional advantage of the present invention is that it, according to an aspect of the present invention, provides storage for various small objects such as wine bottles, books, decorative objects, etc.

A yet additional advantage of the present invention is that it, according to an aspect of the present invention, avoids the expense of existing systems or devices which rely on expensive mechanical systems. The present invention is simple and is less complex than existing systems.

A further advantage of the present invention is that it, according to an aspect of the present invention, is simple and is less likely to break down and require repair.

A further advantage of the present invention is that it, according to an aspect of the present invention, is an attractive piece of furniture which can be modified to suit individual tastes and/or enhance various schemes of interior decoration.

A yet further advantage of the present invention is that it, according to an aspect of the present invention, allows users to select from a wide assortment of decorative materials: prints, paintings, posters, photographs, low-relief sculptures, tapestries, and so forth.

BRIEF DESCRIPTION OF THE DRAWINGS

The features and advantages of aspects of the present invention will become more apparent from the detailed description set forth below when taken in conjunction with the claims and drawings, in which like reference numbers indicate identical or functionally similar elements.

DETAILED DESCRIPTION

Figures 1A, 1B, 1C:
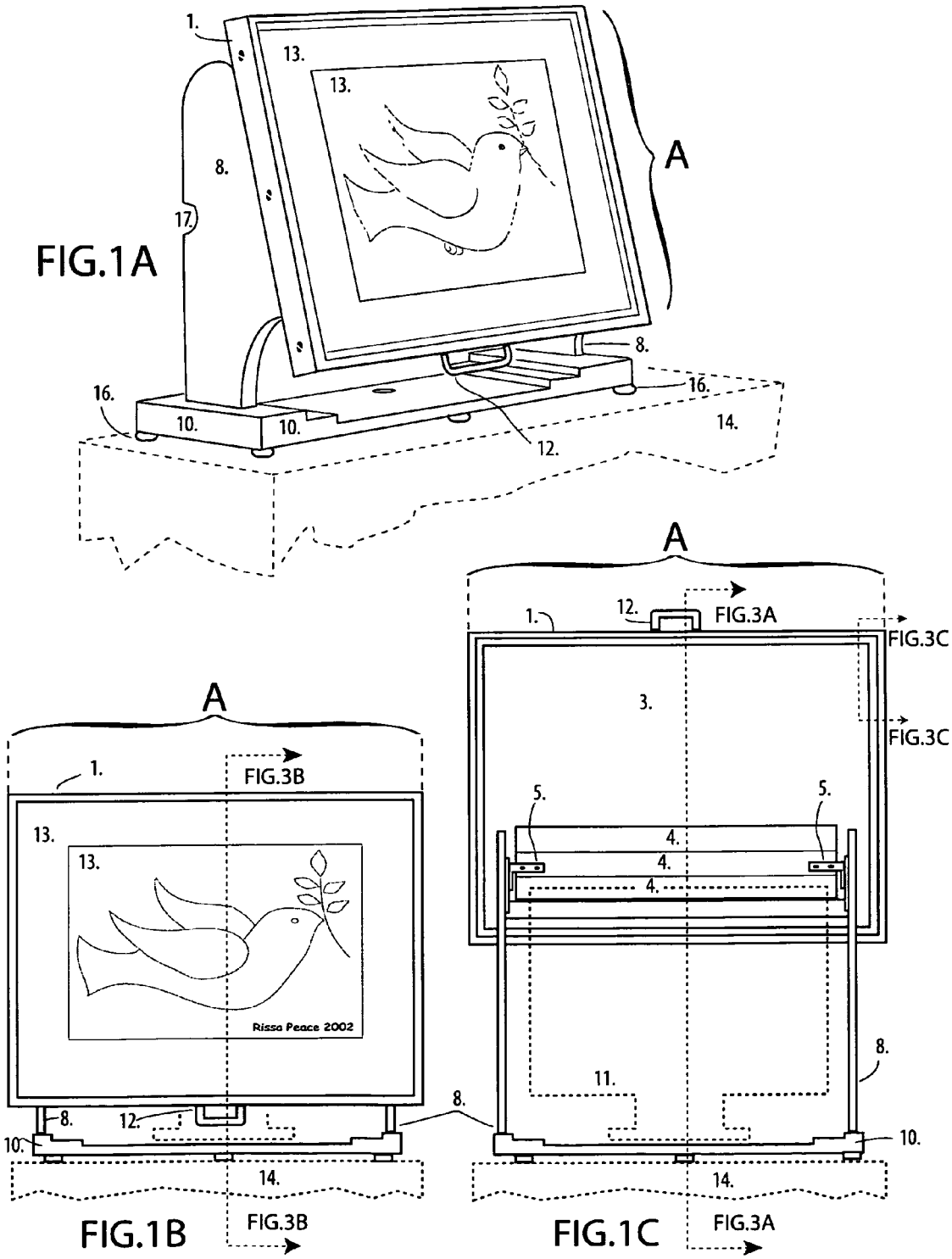
FIG. 1A is perspective view of an apparatus according to an exemplary aspect of the present invention.
FIG. 1B is a frontal view of an apparatus according to an exemplary aspect of the present invention, showing a portion of the apparatus concealing a multimedia device.
FIG. 1C is a frontal view of an apparatus according to an exemplary aspect of the present invention, showing a portion of the apparatus being lifted to reveal a multimedia device.

Aspects of the present invention are directed to an apparatus for enclosing or concealing a stand mounted multimedia device such as a flat screen television.

In an aspect of an embodiment of the present invention, the apparatus may comprise of a horizontal base having two vertical members where the vertical members may be affixed to the horizontal base. Each vertical member has a metal plate affixed to the inner side of each vertical member. The apparatus may also comprise of a pair of angular brackets, with each bracket being rotationally coupled with each metal plate. In other words, the brackets may rotate about a horizontal axis that runs through the metal plates. Each angular bracket and metal plate together form a pivot assembly. The apparatus may also comprise of a horizontal cross-piece, where each end of the cross-piece is affixed to each respective angular bracket. The horizontal cross-piece may be affixed to the lower end of a backing panel, which in turn may be coupled with an art panel and a picture frame all collectively forming a picture frame assembly. In one aspect of an embodiment of the present invention the picture frame assembly is adapted to hold a variety of artwork, including prints, paintings, posters, photographs, low-relief sculptures, etc. In another aspect of an embodiment of the present invention, the art panel may comprise of glazing (glass or acrylic), artwork, picture mat, and/or a backing board. The picture frame assembly conceals the front of the multimedia device and may be pivoted (about a horizontal axis that runs through the metal plates) to a vertical position, thereby opening the front of the apparatus and thus revealing the multimedia device.

The apparatus may also have a horizontal brace which has each end affixed to the rear of each vertical member. The horizontal brace is adapted to support the weight of the panel when the panel has been rotationally translated to the rear of the vertical members about the pivot assembly.

In another aspect of an embodiment of the present invention, the horizontal cross-piece has a first portion having a triangular cross-section and a second portion having a trapezoidal cross-section. Both portions of the horizontal cross-piece may be affixed to the backing panel of the picture frame assembly. In a further aspect, the triangular cross-section of the horizontal cross-piece has one right angle and at least one other angle is in the range of 45-60 degrees. In a yet further aspect, the cross-section of the horizontal cross-piece may assume any shape that allows the horizontal cross-piece to be securely affixed to the backing panel thereby allowing identically shaped angular brackets to be mounted at opposite ends of the horizontal cross-piece in such a way that when the picture frame assembly is in a vertical position bores in the angular brackets create an axis of rotation between them that is both horizontal and at a significantly lower elevation than that of the points where the brackets are attached to the horizontal cross-piece.

In a yet further aspect of an embodiment of the present invention, the horizontal cross-piece may be shaped in a way to prevent too much torque from building on the angular brackets where they are attached to the horizontal cross-piece, when the picture frame assembly is pulled forward.

In another aspect of an embodiment of the present invention, the horizontal cross-piece may have a rectangular flange extending from a side of said horizontal cross-piece, where the side of the horizontal cross-piece is affixed to the backing panel of the picture frame assembly.

In another aspect of an embodiment of the present invention the second portion of the triangular cross-section may be adapted to rest on said horizontal brace when the picture frame assembly has been rotationally translated to the rear of the vertical members about the pivot assembly.

In another aspect of an embodiment of the present invention, the horizontal base is adapted to be bolted to a surface. This may be done to secure the apparatus. An example of such a surface may be a television stand.

In another aspect of an embodiment of the present invention, the pivot assembly further comprises a bore in the angular bracket, a pin running through the bore along an axis and a secured end at each end of the pin. The secured ends prevent the pin from sliding out of the bore and keeps the pin in place. In a further aspect, the secured end may comprise of a screw nut.

In another aspect of the present invention, the pivot assembly further comprises a bore in the angular bracket, a bore in the metal plate, and a rivet that runs through both bores.

In another aspect of an embodiment of the present invention, the picture frame may have a handle which could be used to lift the picture frame assembly over the multimedia device.

In another aspect of an embodiment of the present invention, the rear side of each vertical member may have a groove, which may be adapted to allow the picture frame assembly to be rotationally translated into a vertical position as it is being lifted over the multi-media device.

In yet another aspect of an embodiment of the present invention, each vertical member may have a sloped front edge. This allows for ease of viewing of art work displayed in the picture frame when the multimedia device is concealed by the panel.

In yet another aspect of an embodiment of the present invention, the horizontal base and vertical members are adapted to enclose a multimedia device. As such, various adaptations of the horizontal base and the vertical members may allow for varying range of multimedia devices such as different flat-screen televisions, each having a different width and height.

In yet another aspect of an embodiment of the present invention, the horizontal cross-piece may have a rectangular flange extending from the side of the horizontal cross-piece which is affixed to the base of the picture frame assembly. In a yet further aspect, the rectangular flange may be adapted to rest on the horizontal brace when the picture frame assembly has been rotationally translated to the rear of the vertical members by lifting the picture frame assembly about the pivot assembly. The rectangular flange thus supports the weight of the picture frame assembly.

In yet another aspect of an embodiment of the present invention, the backing panel may be coupled with the picture frame by way of a plurality of screws. In a further aspect where the picture frame is enclosed by the panel, the screws will couple both the backing panel and the picture frame along their respective outer boundaries.

Aspects of the present invention will now be described in more detail herein in terms of the above exemplary context and the accompanying figures. This description is for convenience only and is not intended to limit the application of aspects of the present invention. In fact, after reading the following description, it will be apparent to those skilled in the relevant art(s) how to implement aspects of the following invention in alternative ways.

Referring now to FIG. 1A, a perspective view of an apparatus according to an exemplary aspect of the present invention is shown. In the figure, a picture frame 1, backing panel 3 (not shown) and art panel 13, collectively picture frame assembly "A", is shown with picture frame assembly "A" in a concealing position thereby concealing the multimedia device or, where there is no multimedia device, a resting position.

Referring now to FIGS. 1B & 1C, frontal views of the apparatus according to an aspect of an embodiment of the present invention are shown with picture frame assembly "A" in a concealing position—thereby concealing multimedia device 11 (FIG. 1B) and picture frame assembly in a revealing position—thereby revealing multimedia device 11 (FIG. 1C).

Figure 2A:
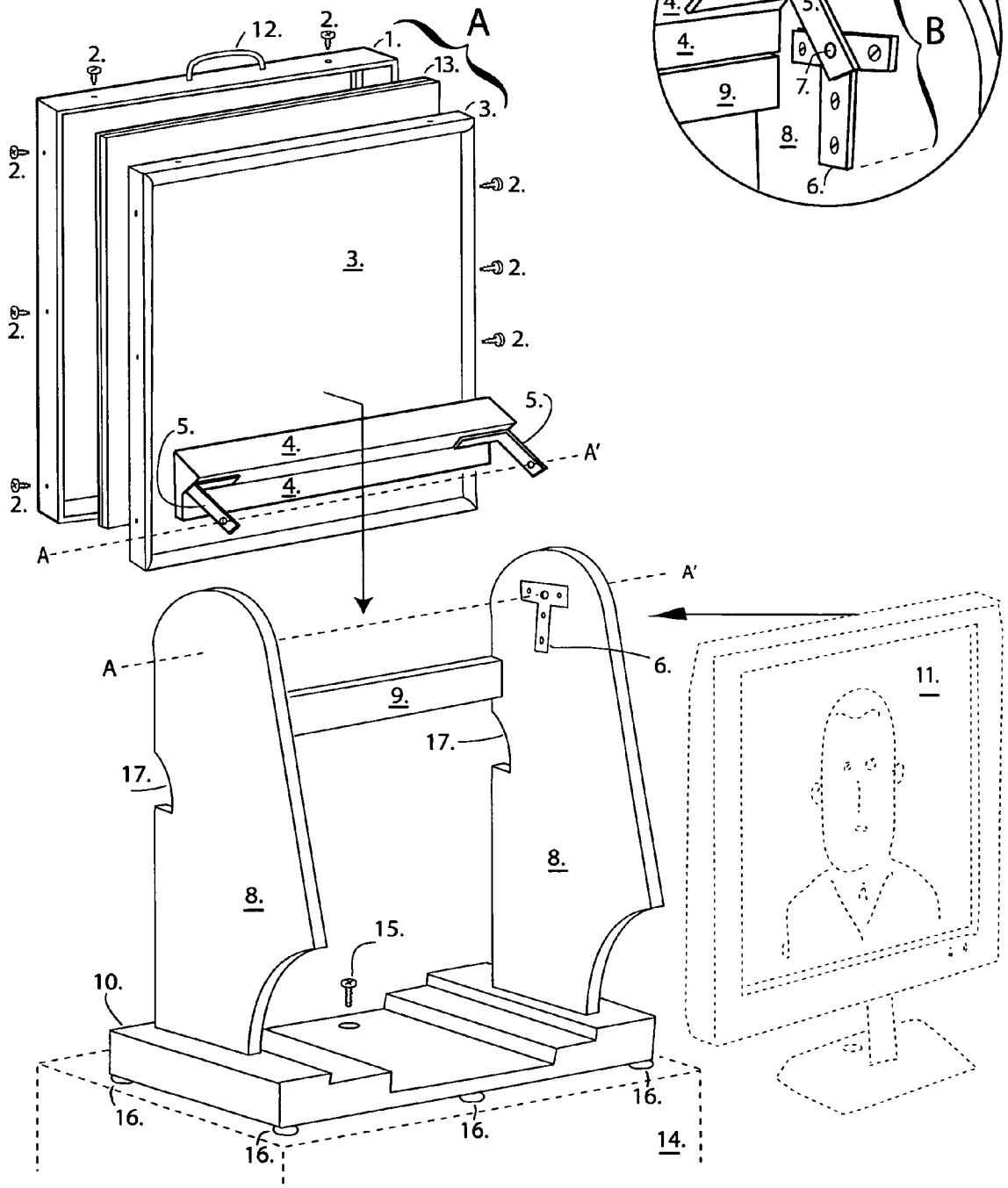
FIG. 2A is an exploded view of an apparatus according to an exemplary aspect of the present invention.

Referring now to FIG. 2A, an exploded view of an apparatus according to an aspect of an embodiment of the present invention is shown. Here, picture frame assembly "A" is shown with a plurality of screws 2. Screws 2 are used to couple or install a picture frame 1 with backing panel 3. In one aspect of an embodiment of the present invention, backing panel 3 may be installed within the confines of picture frame 1 whereby screws 2 secure backing panel 3 within picture frame 1. Art panel 13 may be installed between picture frame 1 and backing panel 3 as shown.

Located at and affixed to the lower part of backing panel 3 is horizontal cross-piece 4. Horizontal cross-piece 4 is further connected with angular brackets 5. Angular brackets 5 pivot picture frame assembly "A", by way of horizontal cross-piece 4, about metal pieces 6, which are affixed on the inner sides of vertical members 8.

Figure 2B:
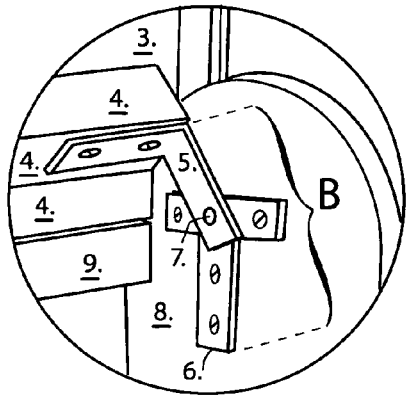
FIG. 2B is a detailed view of a pivot assembly according to an exemplary aspect of the present invention.

Referring now to FIG. 2B, a detailed view of a pivot assembly according to an exemplary aspect of the present invention is shown. The pivot assembly comprises of angular bracket 5, metal piece 6 and a pivot point 7. In one aspect, pivot point 7 may comprise of a bore and a pin through the bore. In another aspect, each pin may be secured at each end by a secured piece such as a screw nut or similar element as is known in the art. In yet another aspect, pivot point 7 may comprise of a bore and a rivet through the bore.

Referring back to FIG. 2A, each metal piece 6 is affixed on the inner side of a vertical member 8 and aligned along an axis A-A' as shown. Each vertical member 8 is further affixed to a horizontal base 10. The distance between vertical members 8 and the height of vertical members 8 may, in an aspect of an embodiment of the present invention, be adapted to accommodate a varying range of multimedia devices such as different flat-screen televisions, each having a different width and height.

A horizontal brace 9 is affixed to the rear of each vertical member 8. Horizontal brace 9 is used to support picture frame assembly "A" when "A" has been rotationally translated about pivot assembly "B" and lifted over multimedia device 11.

Figure 3A:
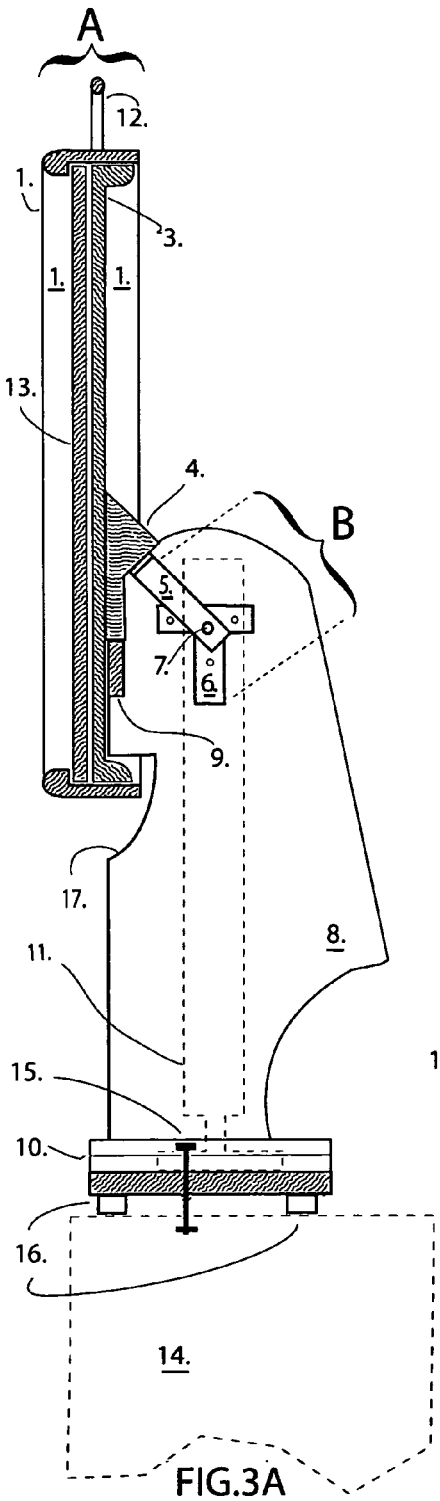
FIG. 3A is cross-sectional view of an apparatus according to an exemplary aspect of the present invention, showing a portion of the apparatus being lifted to reveal a multimedia device.

Referring now to FIG. 3A, a cross-sectional view of an apparatus according to an exemplary aspect of the present invention, showing picture frame assembly "A" being lifted to reveal a multimedia device is shown. When "A" is lifted as shown in FIG. 3A, multimedia device 11 is exposed and is available for use. "A" is supported by horizontal brace 9 which also holds "A" in its vertical position. Groove 17 as found in the rear of vertical members 8 is used to accommodate the inverted end of "A" as shown. "A" may be raised or brought down by use of handle 12.

Figure 3B:
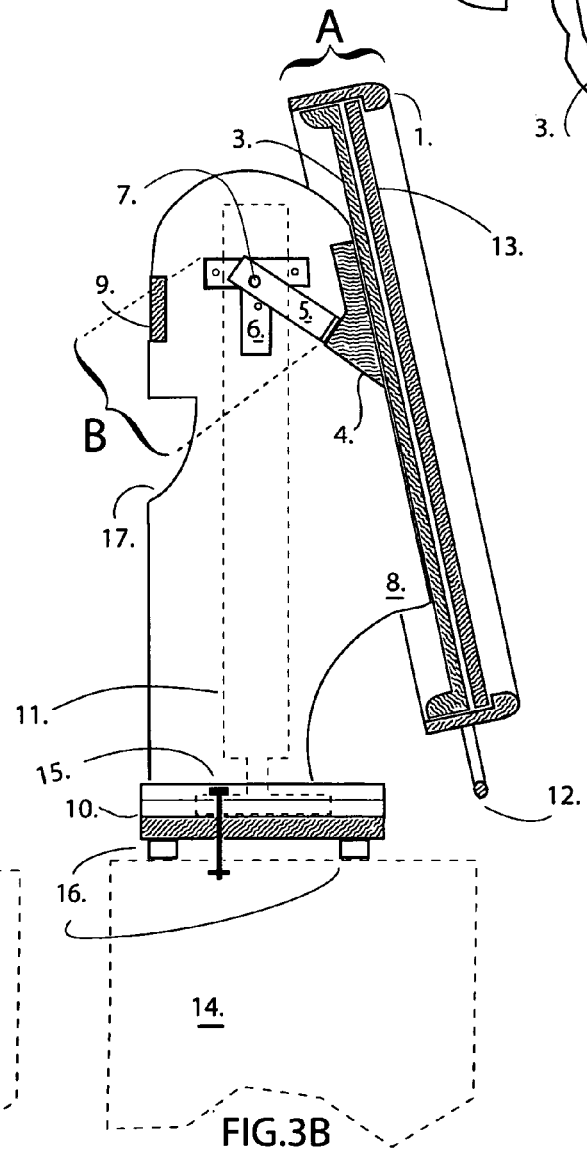
FIG. 3B is cross-sectional view of an apparatus according to an exemplary aspect of the present invention, showing a portion of the apparatus concealing a multimedia device.

Referring now to FIG. 3B, a cross-sectional view of an apparatus according to an exemplary aspect of the present invention, showing picture frame assembly "A" concealing multimedia device 11 is shown. When multimedia device 11 is not in use, picture frame assembly "A" may be brought down from its position as shown in FIG. 3B to conceal multimedia device 11. Artwork or any other display that may be installed in art panel 13 may then be visible and viewed. In an aspect of an embodiment of the present invention, horizontal base 10 may be secured to a surface 14. In another aspect, horizontal base 10 may be secured by way of a bolt assembly 15 on either side of horizontal base 10. In another aspect of an embodiment of the present invention, bolt 15 may be used to hold multimedia device 11 to horizontal base 10. Alternatively, bolt 15 may be used to hold both multimedia device 11 and horizontal base 10 to surface 14.

Feet 16 may be used to keep horizontal base 10 of the apparatus off surface 14. Feet 16 may be made out of rubberized or plastic material.

Figure 3C:
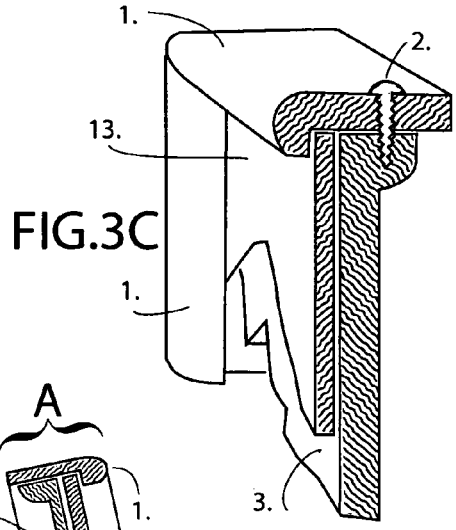
FIG. 3C is a cut-away view of the corner of an apparatus according to an exemplary aspect of the present invention.

Referring now to FIG. 3C, a cut-away view of the corner of picture frame assembly "A" according to an exemplary aspect of the present invention is shown. In this figure, picture frame 1 is shown coupled to backing panel 3 by way of screw 2. Art panel 13, in one aspect of an embodiment of the present invention, may be held in place by an overhang structure of picture frame 1 as shown.

While various aspects of the present invention have been described above, it should be understood that they have been presented by way of example, and not limitation. It will be apparent to persons skilled in the relevant art(s) that various changes in form and detail can be made therein without departing from the spirit and scope of aspects of the present invention. Thus, aspects of the present invention should not be limited by any of the above described exemplary aspects, but should be defined only in accordance with the following claims and their equivalents.

In addition, it should be understood that the figures in the attachments, which highlight the structure, methodology, functionality and advantages of aspects of the present invention, are presented for example purposes only.

The invention claimed is:

1. An apparatus for concealing a multimedia device comprising:

a horizontal base having two vertical members, said vertical members being affixed to said horizontal base, wherein each vertical member has a metal plate affixed to an inner portion of each vertical member;

a pair of angular brackets, each bracket being rotationally coupled with each said metal plate, said angular bracket and metal plate forming a pivot assembly;

a horizontal cross-piece, wherein each end of said horizontal cross-piece is affixed to each said angular bracket and wherein said horizontal cross-piece is rotationally coupled with said pivot assembly;

a backing panel coupled with a picture frame and an art panel thereby forming a picture frame assembly, wherein said backing panel is affixed to said horizontal cross-piece; and a horizontal brace, affixed to a rear portion of said each vertical member, said horizontal brace being adapted to receive and support a picture frame assembly by contact with said horizontal crosspiece when said picture frame assembly has been rotationally translated to the rear of said vertical members about said pivot assembly.

2. The apparatus according to claim 1, wherein said horizontal cross-piece has a first portion having a triangular cross-section and a second portion having a trapezoidal cross-section wherein both portions are affixed to said backing panel.

3. The apparatus according to claim 2, wherein said triangular cross-section of said horizontal cross-piece has one right angle and at least one other angle is in the range of 45-60 degrees.

4. The apparatus according to claim 2, wherein said horizontal cross-piece has a rectangular flange extending from a side of said horizontal cross-piece, wherein said side is affixed to said panel.

5. The apparatus according to claim 4, wherein said second portion of said triangular cross-section is adapted to rest on said horizontal brace when said panel and picture frame has been rotationally translated to the rear of said vertical members about said pivot assembly.

6. The apparatus according to claim 1, wherein said horizontal base is adapted to be bolted to a surface.

7. The apparatus according to claim 1, wherein said art panel comprises of a glazing, artwork, picture framing mat and backing material.

8. The apparatus according to claim 1, wherein said pivot assembly further comprises a bore in said angular bracket, a pin running through said bore and a secured end at each end of said pin for preventing said pin from sliding out of said bore.

9. The apparatus according to claim 1, wherein said pivot assembly further comprises of a bore in said angular bracket and a rivet running through said bore.

10. The apparatus according to claim 1, wherein said picture frame assembly has a handle.

11. The apparatus according to claim 1, wherein the rear side of each vertical member has a groove.

12. The apparatus according to claim 11, wherein said groove is adapted to receive a portion of said picture frame assembly.

13. The apparatus according to claim 1, wherein said vertical member has a sloped front edge.

14. The apparatus according to claim 1, wherein said horizontal base and vertical members are adapted to enclose a multimedia device.

15. The apparatus according to claim 1, wherein said picture frame is coupled with said backing panel by way of a plurality of screws.

* * * * *